US009497830B1

(12) United States Patent
Yoakum et al.

(10) Patent No.: US 9,497,830 B1
(45) Date of Patent: Nov. 15, 2016

(54) NETWORK-CONNECTED LIGHTING STRUCTURE WITH CLIMATE SENSOR, AND RELATED COMPONENTS, SYSTEMS, AND METHODS

(71) Applicant: Avaya Inc., Santa Clara, CA (US)

(72) Inventors: John H. Yoakum, Cary, NC (US); Clark D. Petrie, Colts Neck, NJ (US)

(73) Assignee: Avaya Inc., Santa Clara, CA (US)

( * ) Notice: Subject to any disclaimer, the term of this patent is extended or adjusted under 35 U.S.C. 154(b) by 0 days.

(21) Appl. No.: 14/812,203

(22) Filed: Jul. 29, 2015

(51) Int. Cl.
*H05B 37/02* (2006.01)

(52) U.S. Cl.
CPC ..... *H05B 37/0227* (2013.01)

(58) Field of Classification Search
CPC .... H05B 7/02; H05B 33/08; H05B 33/0845; H05B 33/0815; H05B 37/0272; H05B 41/36; F24F 11/006; F24F 11/001; F24F 11/0015; F24F 11/0034
USPC ..... 315/291–297, 307, 308
See application file for complete search history.

(56) References Cited

U.S. PATENT DOCUMENTS

| | | | | |
|---|---|---|---|---|
| 6,697,757 | B2 * | 2/2004 | Eckel | H05B 37/02 702/127 |
| 7,499,679 | B2 | 3/2009 | Yang et al. | |
| 8,610,376 | B2 | 12/2013 | Chemel et al. | |
| 8,804,622 | B1 | 8/2014 | Thai et al. | |
| 2014/0217927 | A1 | 8/2014 | Quinn | |

* cited by examiner

*Primary Examiner* — Jimmy Vu
(74) *Attorney, Agent, or Firm* — Sheridan Ross P.C.

(57) ABSTRACT

A lighting structure having a climate sensor is disclosed. In one example, a lighting structure includes at least one light source and at least one climate sensor. Each climate sensor is configured to determine at least one ambient climate characteristic value that quantifies an ambient climate characteristic at a location distant from the lighting structure. For example, an ambient climate characteristic may be an ambient temperature of a distant object in the same room as the lighting structure. The lighting structure also includes a controller in communication with the at least one climate sensor. The controller is configured to receive the at least one ambient climate characteristic value from the at least one climate sensor. The controller is further configured to transmit information based on the at least one ambient climate characteristic value to a network.

22 Claims, 5 Drawing Sheets

NETWORK-CONNECTED LIGHTING STRUCTURE WITH CLIMATE SENSOR, AND RELATED COMPONENTS, SYSTEMS, AND METHODS

RELATED APPLICATIONS

This application is related to "NETWORK-CONNECTED ACCESS POINT WITH ENVIRONMENTAL SENSOR, AND RELATED COMPONENTS, SYSTEMS, AND METHODS," application Ser. No. 14/812,290 filed on Jul. 29, 2015, the disclosure of which is hereby incorporated herein by reference in its entirety.

This application is related to "NETWORK-CONNECTED SEMI-FIXED LOCATION TELEPHONE WITH ENVIRONMENTAL SENSOR, AND RELATED COMPONENTS, SYSTEMS, AND METHODS" application Ser. No. 14/812,348 filed on Jul. 29, 2015, the disclosure of which is hereby incorporated herein by reference in its entirety.

TECHNICAL FIELD

This disclosure is related to a lighting structure, and more specifically to a network-connected lighting structure with a climate sensor, and related components, systems, and methods.

BACKGROUND

As wireless networks and internet access becomes more commonplace and ubiquitous, network connectivity is now being added to a variety of different devices, including those devices not commonly associated with computing applications. This phenomenon is commonly referred to as the "Internet of Things" (IoT). For many widely deployed devices, these newly added network functions enhance and extend their main functionality. For example, a network-connected thermostat may enable remote control and monitoring of temperature characteristics in a dwelling or other structure. However, this connectivity also permits additional functionality that may not be directly related to the device's primary functionality, or that may interact with the device's primary functionality in unexpected ways.

SUMMARY

This disclosure is related to a lighting structure, and more specifically to a network-connected lighting structure with a climate sensor, and related components, systems, and methods. Embodiments include a lighting structure having a climate sensor, and related components, systems, and methods. In one embodiment, a lighting structure includes at least one light source and at least one climate sensor. Each climate sensor is configured to determine at least one ambient climate characteristic value that quantifies an ambient climate characteristic at a location distant from the lighting structure. For example, an ambient climate characteristic may be an ambient temperature of an area such as a room, or of a distant object in the same room as the lighting structure. The lighting structure also includes a controller in communication with the at least one climate sensor. The controller is configured to receive the at least one ambient climate characteristic value from the at least one climate sensor. The controller may be further configured to transmit information based on the at least one ambient climate characteristic value to a network. In another non-limiting embodiment, the controller may be configured to affect the output of the light source in the structure based on the ambient climate characteristic. One advantage of this arrangement is that a number of lighting structures within a building can gather individual data points relating to a climate within a defined area, such as a shared space in an office building, an area in a warehouse or other structure, or a climate-monitored space within an area illuminated by a light structure. Because each lighting structure is stationary with a known (or knowable) location, the individual data points can be used to determine climate properties of different sub-areas within the defined area.

In one embodiment, a lighting structure is disclosed. The lighting structure comprises at least one light source. The lighting structure also comprises at least one climate sensor. The at least one climate sensor is configured to determine at least one ambient climate characteristic value that quantifies an ambient climate characteristic at a location outside the lighting structure. The lighting structure further comprises a controller in communication with the at least one climate sensor. The controller is configured to receive the at least one ambient climate characteristic value from the at least one climate sensor. The controller is further configured to transmit information based on the at least one ambient climate characteristic value to a network.

In one embodiment, a network-connected lighting system is disclosed. The system comprises a system controller. The system further comprises a plurality of lighting structures in communication with the system controller via a network. Each lighting structure comprises at least one light source. Each lighting structure further comprises at least one climate sensor. The at least one climate sensor is configured to determine at least one ambient climate characteristic value that quantifies an ambient climate characteristic at a location outside the lighting structure. Each lighting structure further comprises a structure controller in communication with the at least one climate sensor. The structure controller is configured to receive the at least one ambient climate characteristic value from the at least one climate sensor. The structure controller is further configured to transmit information based on the at least one ambient climate characteristic value to the system controller via the network.

Those skilled in the art will appreciate the scope of the disclosure and realize additional aspects thereof after reading the following detailed description of the embodiments in association with the accompanying drawing figures.

BRIEF DESCRIPTION OF THE DRAWINGS

The accompanying drawing figures incorporated in and forming a part of this specification illustrate several aspects of the disclosure, and together with the description serve to explain the principles of the disclosure.

DETAILED DESCRIPTION

Figure 1:
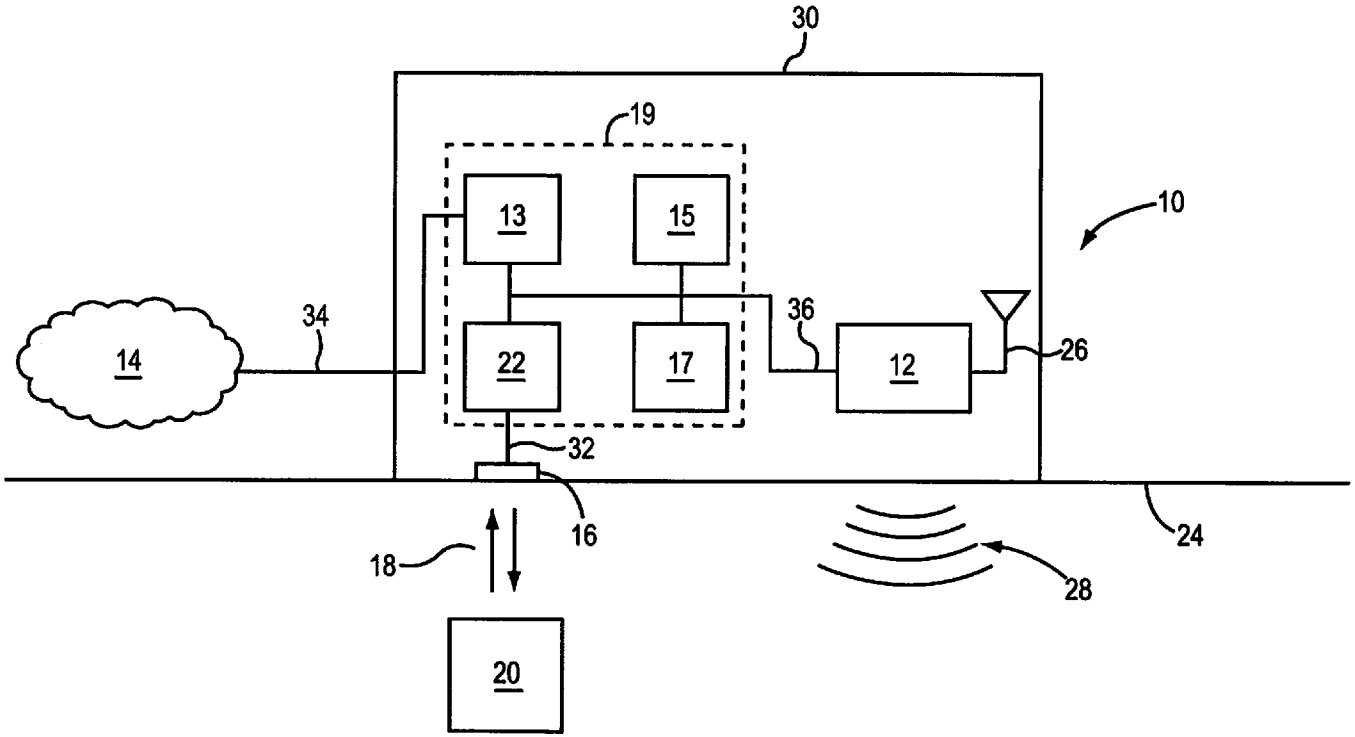
FIG. 1 illustrates a schematic diagram of a network-connected lighting structure according to an embodiment.

The embodiments set forth below represent the information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Any flowcharts discussed herein are necessarily discussed in some sequence for purposes of illustration, but unless otherwise explicitly indicated, the embodiments are not limited to any particular sequence of steps. The use herein of ordinals in conjunction with an element is solely for distinguishing what might otherwise be similar or identical labels, such as "first configuration" and "second configuration," and does not imply a priority, a type, an importance, or other attribute, unless otherwise stated herein. The term "about" used herein in conjunction with a numeric value means any value that is within a range of ten percent greater than or ten percent less than the numeric value.

This disclosure is related to a lighting structure, and more specifically to a network-connected lighting structure with a climate sensor, and related components, systems, and methods. Embodiments include a lighting structure having a climate sensor, and related components, systems, and methods. In one embodiment, a lighting structure includes at least one light source and at least one climate sensor. Each climate sensor is configured to determine at least one ambient climate characteristic value that quantifies an ambient climate characteristic at a location distant from the lighting structure. For example, an ambient climate characteristic may be an ambient temperature of an area such as a room, or of a distant object in the same room as the lighting structure. The lighting structure also includes a controller in communication with the at least one climate sensor. The controller is configured to receive the at least one ambient climate characteristic value from the at least one climate sensor. The controller may be further configured to transmit information based on the at least one ambient climate characteristic value to a network. In another non-limiting embodiment, the controller may be configured to affect the output of the light source in the structure based on the ambient climate characteristic. One advantage of this arrangement is that a number of lighting structures within a building can gather individual data points relating to a climate within a defined area, such as a shared space in an office building. Because each lighting structure is stationary with a known (or knowable) location, the individual data points can be used to determine climate properties of different sub-areas within the defined area.

A lighting structure may be a device which provides artificial light, such as by use of an electric light source. Such devices include lighting fixtures (also known as light fittings or luminaires) which have a body and at least one light socket to hold a removable electric light source such as a light bulb (sometimes referred to as a "lamp") or light-emitting diode (LED). Lighting fixtures may be attached to a surface of a wall or ceiling, may be suspended, may be attached to a pole or other physical structure, may be recessed from a surface of a wall or ceiling, and may be attached to a track structure. Lighting fixtures may include structures that direct light, diffuse light, create pleasing visual effects, or a combination of these effects. Lighting structures also include lamps which may sit on a table or floor, are typically free-standing, have one or more light sockets, and may include one or more lampshade structures which diffuse or direct light from a light source. Light structures also include light panels, which are structures that contain one or more arrays of LEDs. The LEDs may be of a variety of types and colors which may be used alone or in combinations that allow a variety of visual effects to be created. Light structures also include light bulbs or other replaceable light sources or units that contain one or more LEDs or other light generation components.

In this regard, FIG. 1 illustrates a lighting structure 10 having a light source 12 and a climate sensor 14. The climate sensor 14 is configured to determine at least one ambient climate characteristic value that quantifies an ambient climate characteristic 16 at a location outside the lighting structure 10. The lighting structure 10 also includes a controller 20 in communication with the at least one climate sensor 14. The controller 20 is configured to receive the at least one ambient climate characteristic value from the at least one climate sensor 14. The controller 20 is also configured to determine information based on the at least one ambient climate characteristic value, and to transmit the information based on the at least one ambient climate characteristic value to a network 22.

In this example, the lighting structure 10 includes a light bulb 24 defining an interior space 26. An LED element 28 or other type of light source is disposed inside the interior space 26 in this embodiment, and may also be in communication with the controller 20. The light bulb 24 is installed in a fixture 30, which may in turn be permanently installed in a known or knowable location on or inside a structure. In this example, the climate sensor 14 is a directional temperature sensor pointed at a distant object 18 within the line-of-sight of the climate sensor 14. Here, the climate sensor 14 is configured to detect infrared radiation corresponding to the climate characteristic 16, i.e., the temperature at the distant object 18 location. It should be understood that some types of climate sensors 14 may instead be configured to detect infrared radiation in a conical region corresponding to the climate characteristic in a defined area, such as an area intended to be inhabited or monitored, rather than a climate characteristic of an individual object 18. It should also be understood that other types of climate sensors 14 may be used, such as a laser-based temperature sensor, an audio sensor, a video sensor, a still or a video camera, or other sensor that is capable of detecting a temperature or other climate characteristic at a location away from the lighting structure 10.

It should be understood that some types of sensors may be unsuitable for use with the lighting structure 10. For example, in this embodiment, the climate characteristic 16 is a remote climate characteristic that is distant from the lighting structure 10. This is in contrast to an immediate ambient climate characteristic of the area in the immediate vicinity of the lighting structure 10. In this regard, a temperature gauge that is configured to monitor an immediate ambient climate characteristic of the structure itself or in the immediate vicinity thereof would not be configured to also detect a remote ambient climate characteristic 16 at a location away from the lighting structure 10 because an ambient temperature of the lighting structure 10 may be significantly higher than the ambient temperature of a distant object 18 at a remote location away from the lighting structure 10.

In this embodiment, the climate sensor 14 is connected to the controller by a wired sensor connection 32, but it should be understood that the climate sensor 14 may alternatively use a wireless communication connection, such as a wireless transmitter, a receiver, and/or a transceiver in other embodiments. Likewise, in this embodiment, the controller 20 is connected to the network 22 via a wired network connection 34, but it should also be understood that the climate sensor 14 may alternatively use a wireless communication connection in other embodiments.

In this embodiment, the climate sensor 14 is a stationary directional temperature sensor. It should be understood, however, that other types of climate sensors 14 may be used. For example, the climate sensor 14 may have one or more adjustable parameters, such as direction, focus, intensity, or other parameters. For example, the climate sensor 14 may have a first configuration configured to determine at least one ambient climate characteristic value that quantifies an ambient climate characteristic at a first location outside the lighting structure, and a second configuration configured to determine at least one ambient climate characteristic value that quantifies an ambient climate characteristic 16 at a second location outside the lighting structure. The parameters may be adjusted manually, remotely, or automatically in response to a determined parameter, for example, via the controller 20. The connection of the controller 20 to the network 22 may also provide for remote discovery, broadcast, provisioning, or reporting of the individual climate sensors 14 and their respective locations. In another example, the controller 20 may have connectivity to a building thermostat, such that the controller 20 can adjust local temperature settings based on a determined climate characteristic value from the climate sensor(s) 14.

In another example, the climate sensor 14 may be further configured to detect other climate characteristics 16, such as a relative humidity or a barometric pressure, as an alternative to, or in addition to, the ambient temperature at a location outside the lighting structure 10. In this embodiment, the distant object 18 is illustrated as being located remotely from the lighting structure 10. For example, the distant object 18 may be located on a floor of a structure, or be part of a piece of furniture in the same room as the lighting structure. Notably, the climate sensor 14 is not configured to detect the climate characteristic 16 of the lighting structure 10 itself. For example, an electrical structure, such as the lighting structure 10, may have an internal temperature significantly higher than the ambient climate characteristic 16 of the distant object 18 or the location being measured by the climate sensor 14. In fact, using the climate sensor 14 configured to detect the climate characteristic 16 within or in close proximity to the lighting structure 10 may not be suitable for determining the ambient climate characteristic 16 of the distant object 18 or the location because the elevated temperature in and around the lighting structure 10 may not accurately reflect the actual ambient climate characteristics 16 within the overall space in which the lighting structure 10 is installed.

Figure 2:
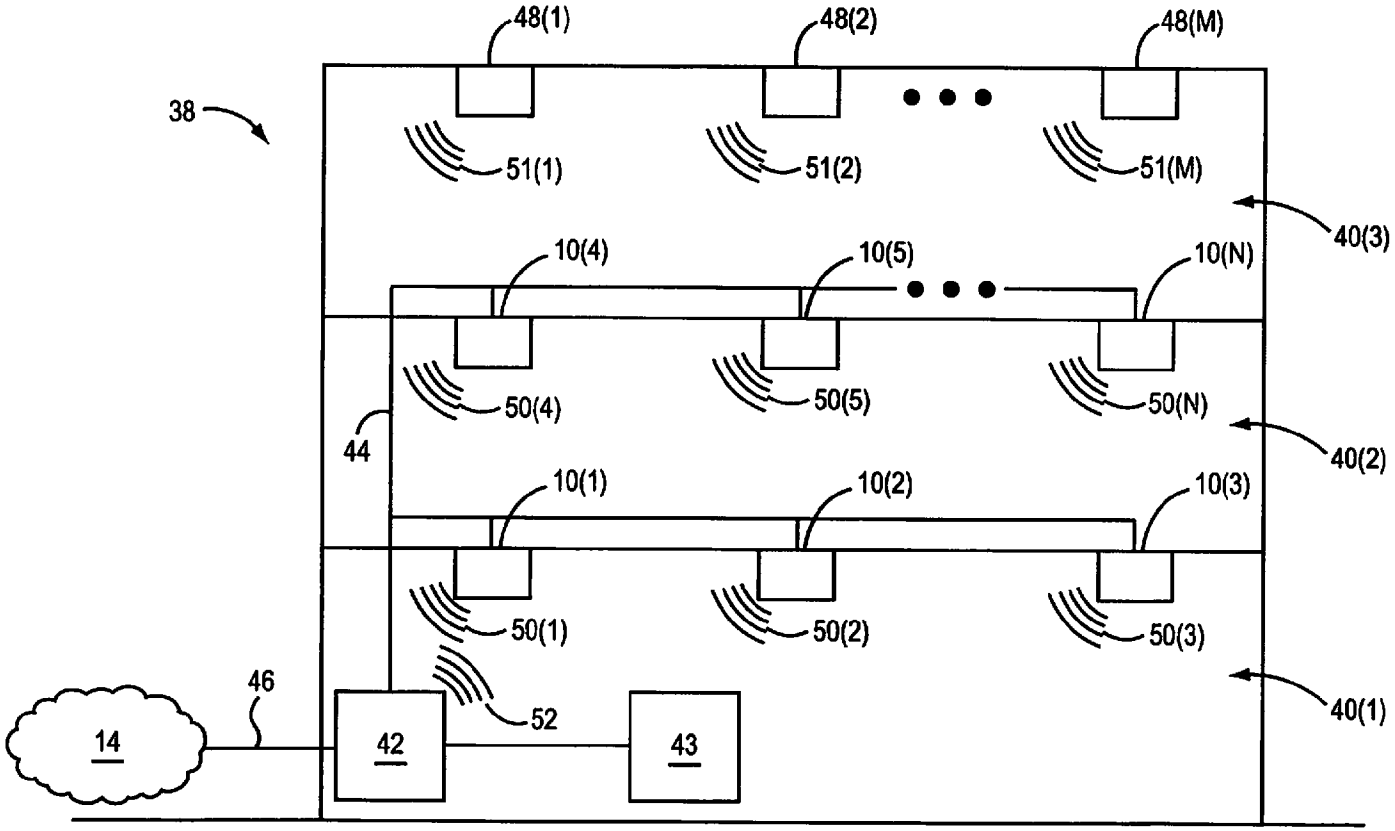
FIG. 2 illustrates a schematic diagram of a network-connected lighting system for a multi-story structure employing the lighting structures of FIG. 1 according to an embodiment.

Because most structures have lighting structures distributed throughout the structure, it becomes possible to gather detailed and granular information about the various climate characteristics within the structure. In this regard, FIG. 2 illustrates a diagram of a multi-story building 36 having a plurality of floors 38(1)-38(3). In this embodiment, a plurality of lighting structures 10(1)-10(N) are distributed across the plurality of floors 38(1) and 38(2). Each lighting structure 10(1)-10(N) is in communication with a centralized system controller 40, for example, via the respective controller 20 of each lighting structure 10. In this embodiment, each lighting structure 10 is in communication with the system controller 40 via a wired controller connection 42. The system controller 40 is connected to a larger network 22, such as the internet, via a communication channel 44.

It may also be desirable, however, to include wireless functionality as an alternative mechanism for communicating with the system controller 40. In this regard, the floor 38(3) of the building 36 includes a plurality of alternative lighting structures 46(1)-46(N). In this embodiment, the internal components of each lighting structure 46 is similar to the internal components of the lighting structure 10 of FIG. 1. In this embodiment, however, rather than requiring a hard wired connection to the system controller 40, each lighting structure 46 communicates with the system controller 40 via a wireless connection. Each lighting structure 46 includes a wireless transceiver 48(1)-48(N) that communicates with a complementary wireless transceiver 50 in the system controller 40.

In this embodiment, the system controller 40 is able to communicate with all of the lighting structures 10(1)-10(N), 46(1)-46(N) simultaneously, thereby allowing the system controller 40 to determine real time information with regard to climate characteristics 16 throughout the building 36. This real time information can be used, for example, to control an HVAC system or to communicate the light source functionality of the lighting structures 10, 46 to an installer or a technician. In another non-limiting embodiment, multiple systems or applications may use the determined climate characteristic value and/or information concurrently. For example, these systems or applications may be in communication with the system controller 40, connected to the network 22, or both.

Figure 3:
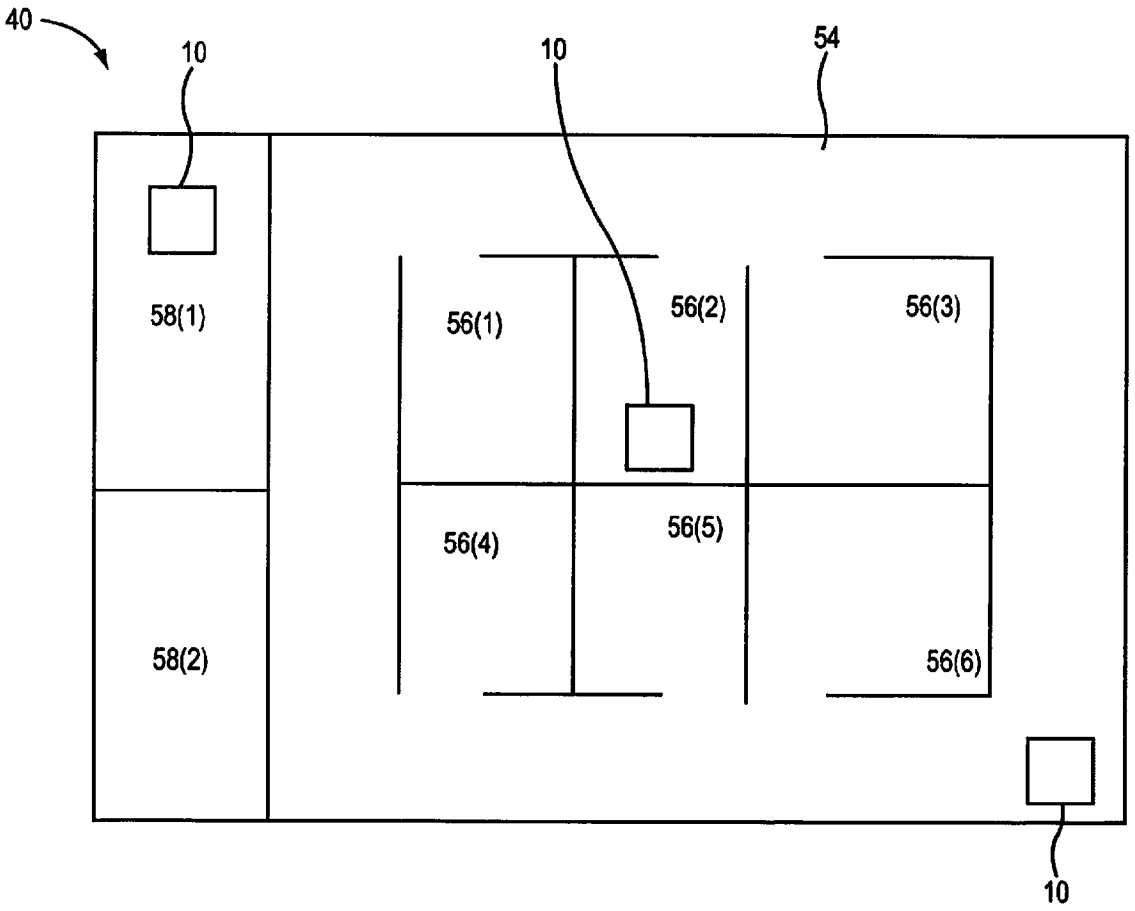
FIG. 3 illustrates a schematic diagram of a floor plan having an array of lighting structures of FIG. 1 according to an embodiment.

In this regard, FIG. 3 illustrates an exemplary simplified floorplan of one of the plurality of floors 38 of the building 36 of FIG. 2. In this example, the floor 38 includes a common area 52 in which a plurality of open cubicles 54(1)-54(6) are arranged. In this example, the floor 38 also includes a pair of closed offices 56(1) and 56(2). The lighting structures 10 are evenly distributed across the ceiling of the floor 38 in this embodiment. It can be seen that the lighting structures 10 may be positioned and distributed such that each area of interest includes at least one lighting structure 10 associated with it. For example, in this embodiment, each cubicle 54 and each office 56 has at least one lighting structure 10 positioned directly overhead. Thus, detailed and specific information about any number of climate characteristics 16 may be determined for a number of different specific locations within the floor 38.

As an example, one application of this arrangement can be to use the controllable LED functionality of the lighting structures 10 to create a "heat map" of the common area 52 that is readily visible to an installer or a technician inspecting the common area 52. For example, the lighting structures 10 within a sub-area 58 of the common area 52 may indicate that the ambient climate characteristics 16 such as the temperature are above a threshold level. Each controller 20 may be further configured to change the light source 12 (not shown) from a first state to a second state based on the at least one ambient climate characteristic value. Here, for example, individual controllers 20 of the lighting structures 10 and/or the system controller 40 may cause respective light sources 12 (not shown) of the lighting structures 10 to turn on or off, increase or decrease in brightness, change color and/or display various illumination patterns based on the determined climate characteristics 16 within the sub-area 58. Likewise, the lighting structures 10 within a second sub-area 60 of the common area 52 may determine that the determined climate characteristic values are below a threshold level, thereby causing the controller 20 and/or the system controller 40 to change the light sources 12 of the lighting structures 10 within the second sub-area 60 to a second lighting state different than a first lighting state, while the lighting structures 10 in a third sub-area 62 exhibit a third lighting state different from the first and second lighting state. These and other functions may also be controlled via external systems or applications, such as, without limitation, a control tool residing on an external device. For example, a mobile device may be connected via the network 22, and may be configured to communicate commands and receive information from one or more lighting structures 10.

Figure 4:
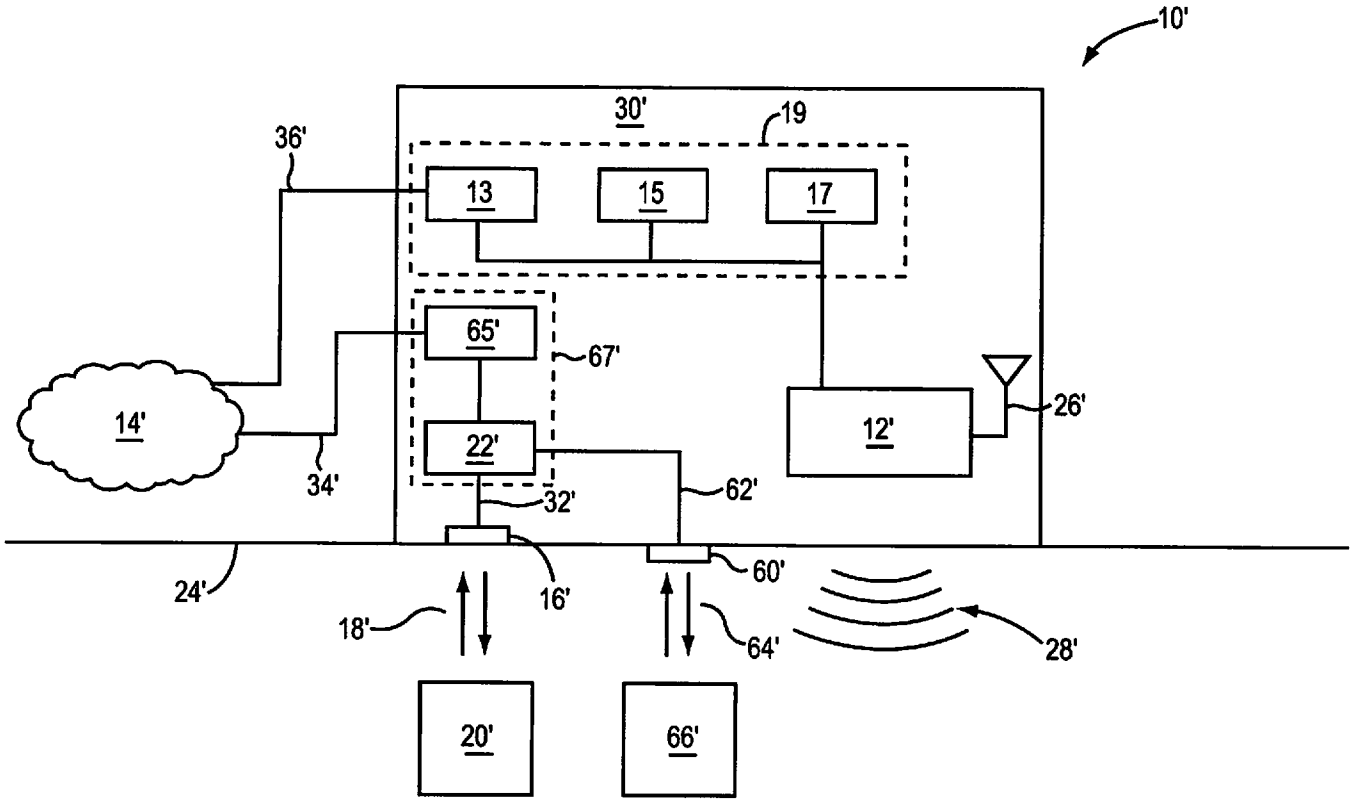
FIG. 4 illustrates a schematic diagram of a network-connected lighting structure according to an alternative embodiment.

It should be understood that the climate sensor 14 is not required to be disposed within or otherwise attached to the light bulb 24 or the other light source 12 of the lighting structure 10 to function properly. In this regard, FIG. 4 illustrates a lighting structure 10' according to an alternative embodiment, in which a climate sensor 14' is located inside a fixture 30' of the lighting structure 10'. In this embodiment, a light source 12' is a "smart" light bulb 24' disposed inside the interior space 26' having a dedicated bulb controller 64'. It should be understood, however, that the light source 12' may be a conventional light bulb in other embodiments. In this embodiment, both the bulb controller 64' and the climate sensor 14' are in communication with a structure controller 66', which is in turn in communication with network 22'. As with FIG. 1, the climate sensor 14' is connected to the structure controller 66' via a wired sensor connection 68'. In this embodiment, also, the bulb controller 64' is also connected to the structure controller 66' by a wired bulb connection 70', and the structure controller 66' is connected to the network 22' by a wired network connection 72' as well. As with FIG. 1, however, it should be understood that one or more of the wired connections 68', 70', and 72' may be substituted with wireless connections as desired.

FIG. 4 also shows additional climate sensor 74' which may be the same or of a different type as climate sensor 14'. In this embodiment, sensor 74' is connected to the fixture controller 66' via a wired sensor connection 76', and may be similar to wired connection 68'. Sensor 74' is positioned to make an environmental measurement of a distant object or area, which may be distant object 18 or may be another distant object or area (not shown). In this manner, multiple environmental sensors 14', 74' may be positioned within a single light structure 10' to make environmental measurements of different distant objects or areas.

Figure 5:
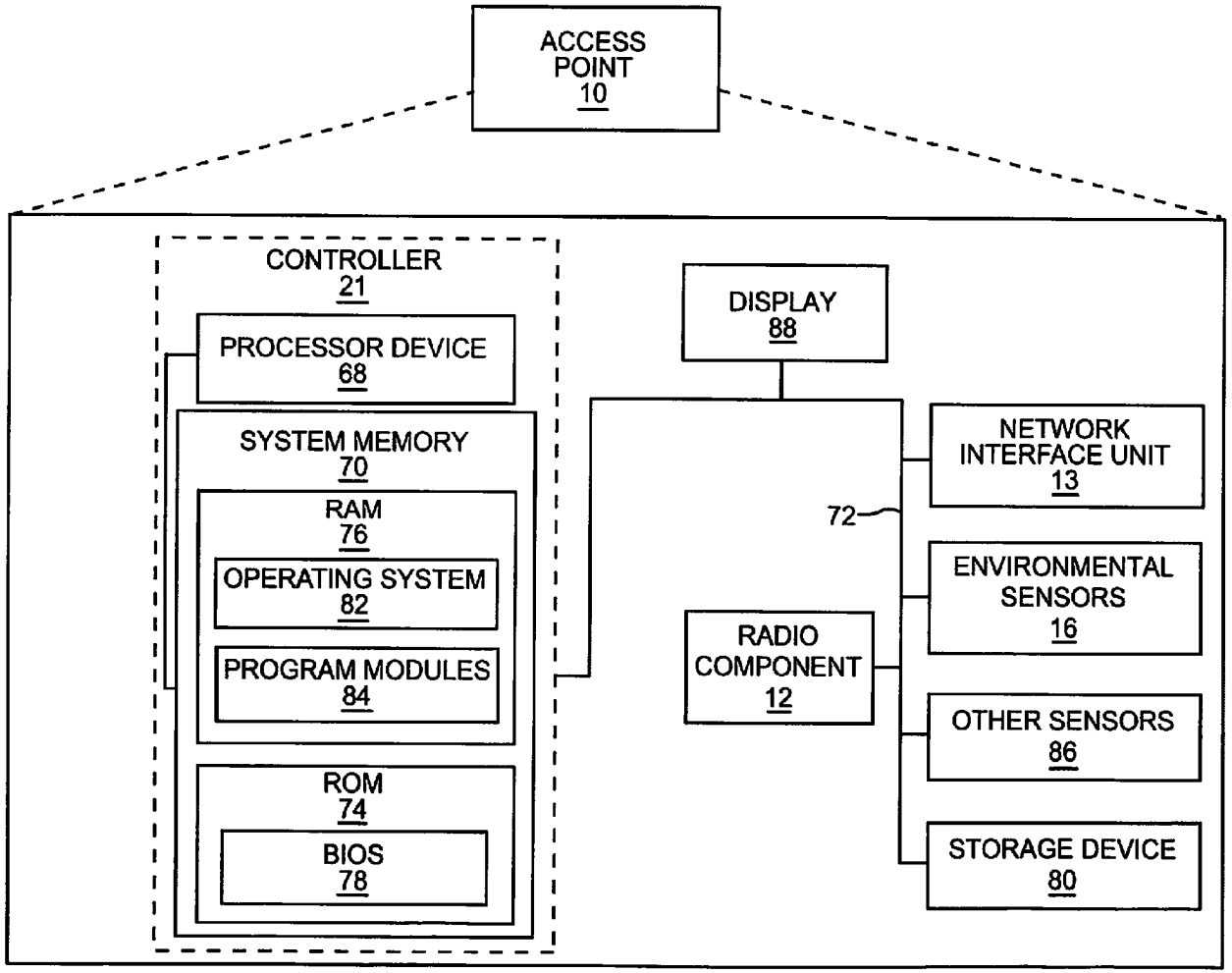
FIG. 5 illustrates a block diagram of a network-connected lighting structure according to one embodiment.

FIG. 5 is a block diagram of a lighting structure 10 according to the embodiment of FIG. 1. It should be understood, however, that the components of FIG. 5 may be used with other embodiments herein as well. The lighting structure 10 may comprise any computing or processing device capable of including firmware, hardware, and/or executing software instructions to implement the functionality described herein, and which is capable of being incorporated into components of the lighting structure 10, including, for example, the light source 12 or the fixture 30. In this example, the lighting structure 10 of FIG. 5 includes the controller 20 having a processor device 74, a system memory 76, and a system bus 78. The system bus 78 provides an interface for system components including, but not limited to, the system memory 76 and the processor device 74. The processor device 74 can be any commercially available or proprietary processor.

The system bus 78 may be any of several types of bus structures that may further interconnect to a memory bus (with or without a memory controller), a peripheral bus, and/or a local bus using any of a variety of commercially available bus architectures. The system memory 76 may include non-volatile memory 80 (e.g., read only memory (ROM), erasable programmable read-only memory (EPROM), electrically erasable programmable read-only memory (EEPROM), etc., and/or volatile memory 82 (e.g., random-access memory (RAM). A basic input/output system (BIOS) 84 may be stored in the non-volatile memory 80 and can include the basic routines that help to transfer the information between the elements within the lighting structure 10.

The lighting structure 10 may further include a computer-readable storage device 86, which may comprise, for example, internal solid state memory, or the like. The computer-readable storage device 86 may provide non-volatile storage of the data, the data structures, the computer-executable instructions, and the like. The data structures can store historical sensor readings which identify the sensor which made the measurement and a timestamp indicating the time the measurement was made. Computer-executable instructions may include pre-defined data processing instructions, or downloaded instructions for data processing at a specified time or interval.

A number of modules can be stored in the computer-readable storage device 86 and/or in the volatile memory 82, including an operating system 88 and one or more program modules 90, which may implement the functionality described herein in whole or in part.

In addition, the lighting structure 10 may include additional components, such as one or more climate sensors 14, described in detail above, other types of sensors 92, and a display 94 or other visual indicator interface. The components of the lighting structure 10 may interact with other components outside of the lighting structure 10, such as a network 22, via a communications interface 96.

Those skilled in the art will recognize improvements and modifications to the preferred embodiments of the disclosure. All such improvements and modifications are considered within the scope of the concepts disclosed herein and the claims that follow.

What is claimed is:

1. A lighting structure comprising:

at least one light source;

at least one climate sensor that:

determines at least one ambient climate characteristic value that quantifies an ambient climate characteristic at a location outside the lighting structure; and a controller in communication with the at least one climate sensor, the controller programmed to:

receive the at least one ambient climate characteristic value from the at least one climate sensor; and transmit information based on the at least one ambient climate characteristic value to a network.

2. The lighting structure of claim 1, wherein the location outside the lighting structure is a remote location from the climate sensor.

3. The lighting structure of claim 1, wherein the at least one ambient climate characteristic is an ambient temperature.

4. The lighting structure of claim 1, wherein the at least one ambient climate characteristic is an ambient humidity.

5. The lighting structure of claim 1, wherein the at least one light source comprises a replaceable light unit, wherein the at least one climate sensor is disposed in the replaceable light unit.

6. The lighting structure of claim 1, further comprising a fixture, wherein the controller is housed in the fixture, the at least one light source is connected to the fixture, and the fixture comprises the at least one climate sensor.

7. The lighting structure of claim 1, further comprising a wired connection between the at least one climate sensor and the controller, wherein the controller is configured to receive the at least one ambient climate characteristic value from the at least one climate sensor via the wired connection.

8. The lighting structure of claim 1, wherein the at least one climate sensor is connected to a wireless transmitter, the controller is connected to at least one wireless receiver, and the controller is configured to receive the at least one ambient climate characteristic value from the at least one climate sensor via a wireless communication between the wireless transmitter and the at least one wireless receiver.

9. The lighting structure of claim 1, wherein the climate sensor has a first configuration configured to determine at least one first ambient climate characteristic value that quantifies at least one first ambient climate characteristic at a first location outside the lighting structure, and a second configuration configured to determine at least one second ambient climate characteristic value that quantifies at least one second ambient climate characteristic at a second location outside the lighting structure.

10. The lighting structure of claim 9, wherein the controller is configured to cause the at least one climate sensor to change between the first configuration and the second configuration.

11. The lighting structure of claim 10, wherein the controller is configured to automatically cause the at least one climate sensor to change between the first configuration and the second configuration responsive to a determined parameter.

12. The lighting structure of claim 1, wherein the controller comprises:

a processor device; and a memory configured to store at least one of the at least one ambient climate characteristic value.

13. The lighting structure of claim 1, wherein the controller is configured to determine the information based on the at least one ambient climate characteristic value prior to transmitting the information to the network.

14. The lighting structure of claim 1, wherein the controller is further configured to change the light source from a first state to a second state based on the at least one ambient climate characteristic value.

15. The lighting structure of claim 14, wherein the second state defines an illumination pattern.

16. The lighting structure of claim 14, wherein the first state is a first brightness state, and the second state is a second brightness state different from the first brightness state.

17. The lighting structure of claim 14, wherein the first state is a first color state, and the second state is a second color state different from the first color state.

18. A network-connected lighting system comprising:

a system controller; and a plurality of lighting structures in communication with the system controller via a network, each lighting structure comprising:

at least one light source;

at least one climate sensor that:

determines at least one ambient climate characteristic value that quantifies an ambient climate characteristic at a location outside the lighting structure; and a structure controller in communication with the at least one climate sensor, the structure controller configured to:

receive the at least one ambient climate characteristic value from the at least one climate sensor; and transmit information based on the at least one ambient climate characteristic value to the system controller via the network.

19. The system of claim 18, wherein each structure controller is further configured to change the respective light source from a first state to a second state based on the at least one ambient climate characteristic value determined by the respective at least one climate sensor.

20. A lighting structure comprising:

at least one receptacle for receiving at least one light source;

at least one climate sensor that:

determines at least one ambient climate characteristic value that quantifies an ambient climate characteristic at a location outside the lighting structure; and a controller in communication with the at least one climate sensor, the controller to:

receiving the at least one ambient climate characteristic value from the at least one climate sensor; and transmitting information based on the at least one ambient climate characteristic value to a network.

21. The lighting structure of claim 20, wherein the at least one climate sensor is disposed in the at least one light source.

22. The lighting structure of claim 21, wherein the controller is disposed in the receptacle.

* * * * *

UNITED STATES PATENT AND TRADEMARK OFFICE

CERTIFICATE OF CORRECTION

PATENT NO. : 9,497,830 B1
APPLICATION NO. : 14/812203
DATED : November 15, 2016
INVENTOR(S) : John H. Yoakum et al.

It is certified that error appears in the above-identified patent and that said Letters Patent is hereby corrected as shown below:

At Column 10, Line 42, please delete "to" therein.

Signed and Sealed this
Fourteenth Day of February, 2017

Michelle K. Lee

Michelle K. Lee
*Director of the United States Patent and Trademark Office*